US007792669B2

(12) United States Patent
Oh et al.

(10) Patent No.: US 7,792,669 B2
(45) Date of Patent: Sep. 7, 2010

(54) VOICING ESTIMATION METHOD AND APPARATUS FOR SPEECH RECOGNITION BY USING LOCAL SPECTRAL INFORMATION

(75) Inventors: Kwang Cheol Oh, Seongnam-si (KR); Jae-Hoon Jeong, Yongin-si (KR)

(73) Assignee: Samsung Electronics Co., Inc., Suwon-Si (KR)

( * ) Notice: Subject to any disclaimer, the term of this patent is extended or adjusted under 35 U.S.C. 154(b) by 827 days.

(21) Appl. No.: 11/657,654

(22) Filed: Jan. 25, 2007

(65) Prior Publication Data

US 2007/0185709 A1 Aug. 9, 2007

(30) Foreign Application Priority Data

Feb. 9, 2006 (KR) ..... 10-2006-0012368

(51) Int. Cl.
*G10L 11/06* (2006.01)

(52) U.S. Cl. ..... 704/208

(58) Field of Classification Search ..... 704/208
See application file for complete search history.

(56) References Cited

FOREIGN PATENT DOCUMENTS

| | | |
|---|---|---|
| JP | 5-136746 | 6/1993 |
| JP | 7-28499 | 1/1995 |
| JP | 10-207491 | 8/1998 |
| JP | 2002-91467 | 3/2002 |
| KR | 1999-0070595 | 9/1999 |

*Primary Examiner*—Susan McFadden
(74) *Attorney, Agent, or Firm*—Staas & Halsey LLP

(57) ABSTRACT

A method and apparatus of estimating a voicing for speech recognition by using local spectral information. The voicing estimation method for speech recognition includes performing a Fourier transform on input voice signals after performing pre-processing on the input voice signals. The method further includes detecting peaks in the input voice signals after smoothing the input voice signals. The method also includes computing every frequency bound associated with the detected peaks, and determining a class of a voicing according to each computed frequency bound.

15 Claims, 6 Drawing Sheets

VOICING ESTIMATION METHOD AND APPARATUS FOR SPEECH RECOGNITION BY USING LOCAL SPECTRAL INFORMATION

CROSS-REFERENCE TO RELATED APPLICATION

This application claims priority from Korean Patent Application No. 10-2006-0012368, filed on Feb. 9, 2006, in the Korean Intellectual Property Office, the disclosure of which is incorporated herein by reference.

BACKGROUND OF THE INVENTION

1. Field of the Invention

The present invention relates to a method and an apparatus of estimating a voicing, i.e. a voiced sound, for speech recognition by using local spectral information.

2. Description of Related Art

In a time domain, a frequency domain or a time-frequency hybrid domain of voice signals, a variety of coding methods that execute signal compression by using statistical properties and human's auditory features have been proposed.

Until now, there have been few approaches to speech recognition by using an extraction of voicing information from voice signals. A method of detecting voiced and unvoiced sounds from a voice signal input is executed generally in the time domain or the frequency domain.

A method, executed in the time domain, uses a zero-crossing rate and/or a frame mean energy of voice signals. Although guaranteeing some detectability in a clean (i.e., quite) environment, this method may show a remarkable drop in detectability in a noisy environment.

Another method, executed in the frequency domain, uses information about low/high frequency components of voice signals or uses pitch harmonic information. This conventional method may, however, estimate a voicing in an entire spectrum region.

FIG. 1 is an example of graph used for estimating a voicing in the whole spectrum region according to such a conventional method.

As shown in FIG. 1, a conventional method estimates a voicing in the entire spectrum region and thus may have some problems. One of the problems is that it unnecessarily refers to certain frequencies lacking voice components. Another problem is that it often fails to determine whether a colored noise is a harmonic or a noise. Additionally, as FIG. 1 shows, it may be difficult in some cases to find harmonic components at 1000 Hz or more.

BRIEF SUMMARY

An aspect of the present invention provides a new voicing estimation method and apparatus, which estimate a voicing according to every frequency bound on a spectrum while considering different voicing features between a voiced consonant and a vowel, and which exactly determine whether a voicing is a voiced consonant or a vowel.

Another aspect of the present invention provides a voicing estimation method and apparatus, which exactly determine whether a voice signal input is a voicing or not and then determines a class of such a voicing to utilize determination results as factors necessary for a pitch detection or a formant estimation.

According to an aspect of the present invention, there is provided a voicing estimation method for speech recognition, the method including: performing a Fourier transform on input voice signals after the input voice signals are pre-processed; detecting peaks in the transformed input voice signals after smoothing the transformed input voice signals; computing frequency bounds respectively associated with each of the detected peaks; and determining a voicing class according to each computed frequency bound.

According to another aspect of the present invention, there is provided a voicing estimation apparatus for speech recognition, the apparatus including: a pre-processing unit pre-processing input voice signals; a Fourier transform unit Fourier transforming the pre-processed input voice signals; a smoothing unit smoothing the transformed input voice signals; a peak detection unit detecting peaks in the smoothed input voice signals; a frequency bound calculation unit computing frequency bounds respectively associated with the detected peaks; and a class determination unit determining a voicing class according to each computed frequency bound.

According to another aspect of the present invention, there is provided a voicing estimation method for speech recognition, the method including: Fourier transforming pre-processed input voice signals; smoothing the transformed input voice signals and detecting at least one peak in the smoothed input voice signals; computing a frequency bound for each detected peak, each frequency bound being based on an associated detected peak; and classifying a voicing based on the frequency bounds According to other aspects of the present invention, there are provided computer-readable storage media storing programs for executing the aforementioned methods.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
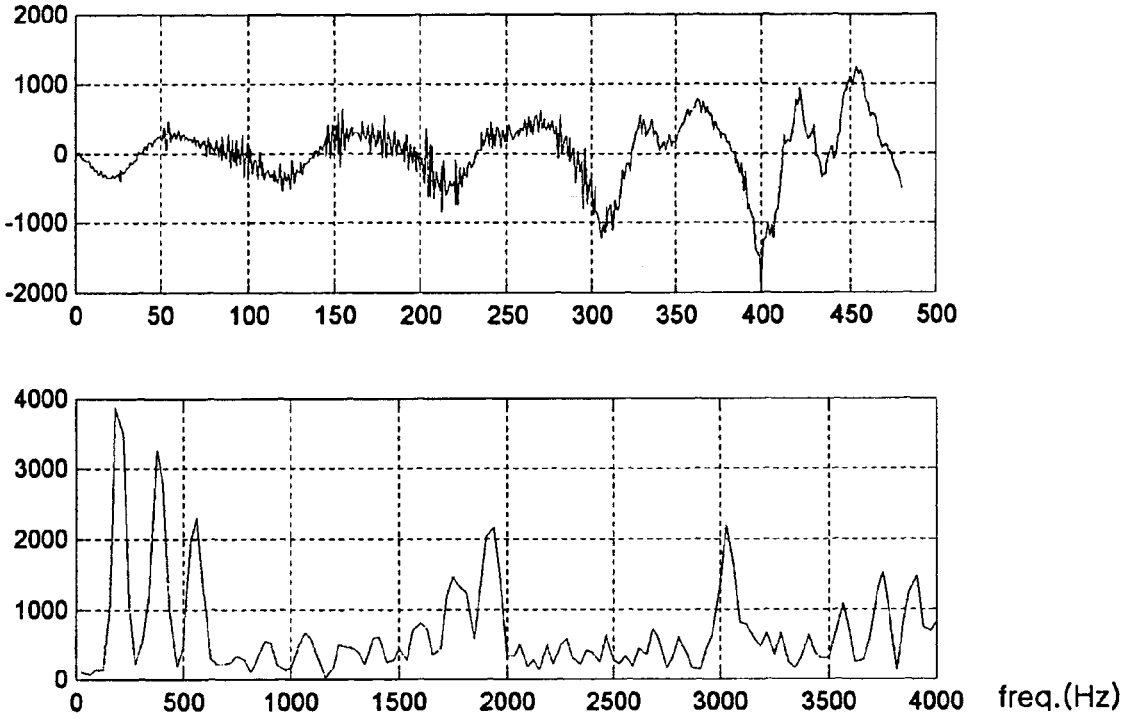
FIG. 1(CONVENTIONAL ART)
FIG. 1 is an example of a graph used for estimating a voicing in an entire spectrum region according to a conventional method.

Reference will now be made in detail to embodiments of the present invention, examples of which are illustrated in the accompanying drawings, wherein like reference numerals refer to the like elements throughout. The embodiments are described below in order to explain the present invention by referring to the figures.

A voicing, created by periodic components of signals, is a linguistically common feature to both a voiced consonant and a vowel. However, a voicing feature appears differently in both. Specifically, a vowel has the periodic signal components in many frequency bounds, whereas a voiced consonant has the periodic signal components in low frequency bounds only. Considering these properties, the present invention estimates a voicing by every frequency bound on a spectrum and provides a method of exactly differentiating between a voiced consonant and a vowel.

Figure 2:
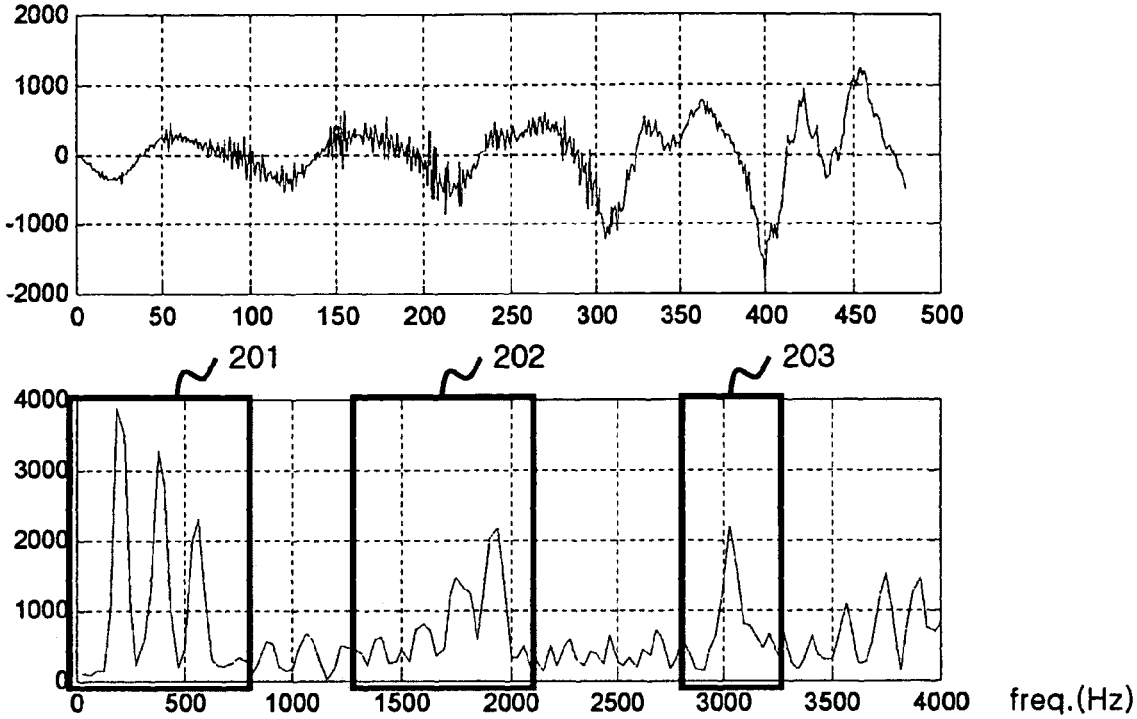
FIG. 2 is an example of a graph used for estimating a voicing by every frequency bound on a spectrum according to an embodiment of the present invention.

FIG. 2 is an example of graph used for estimating a voicing by every frequency bound on a spectrum according to an exemplary embodiment of the present invention.

The present embodiment extracts parameters for a voicing estimation on a spectrum from different sections. As shown in FIG. 2, a first formant bound 201, a second formant bound 202 and a third formant bound 203 are selected in order from a low frequency, and a voicing is obtained from each formant bound. When a voicing exists only in the first formant bound 201, such a voicing falls within a voicing by a voiced consonant.

The first formant bound 201 ranges up to about 800 Hz in a vowel histogram. In the case of a voiced consonant, the first formant bound 201 advantageously ranges up to about 1 kHz.

Figure 3:
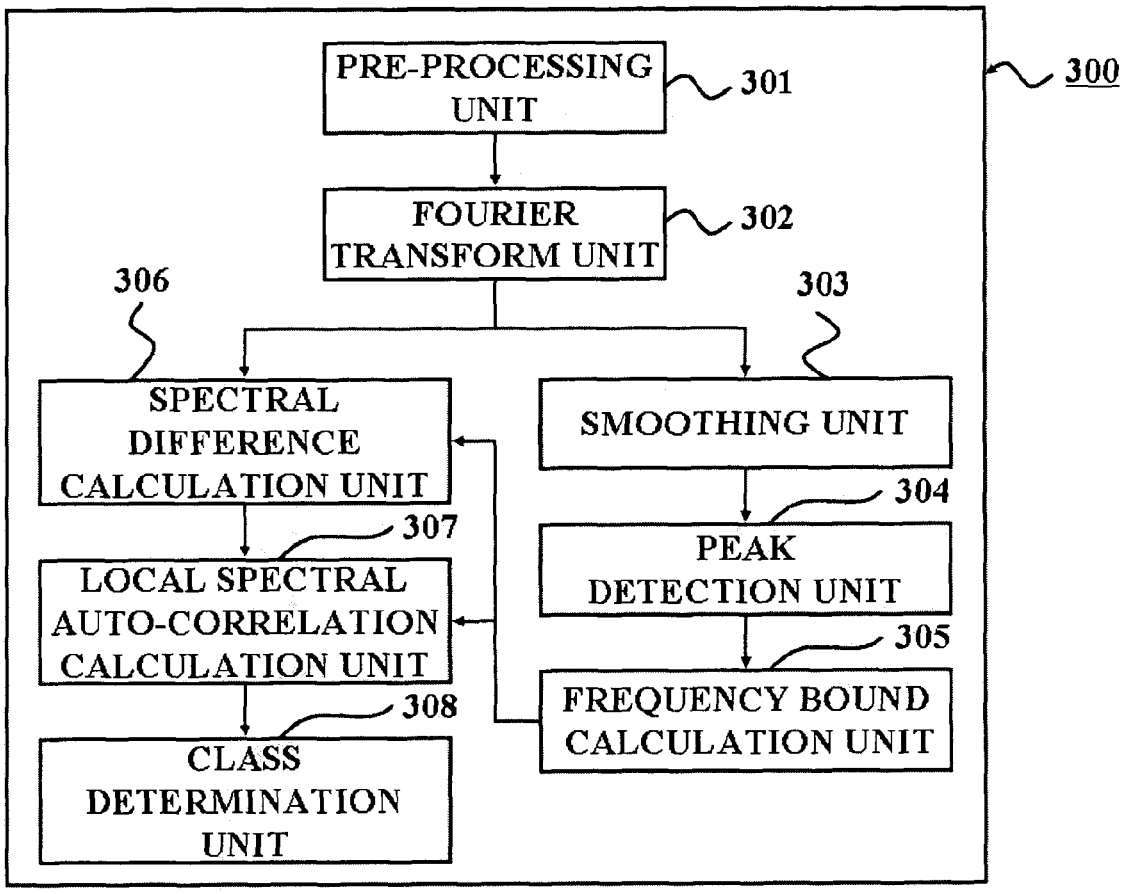
FIG. 3 is a block diagram illustrating a voicing estimation apparatus for speech recognition according to an embodiment of the present invention.

FIG. 3 is a block diagram illustrating a voicing estimation apparatus for speech recognition according to an embodiment of the present invention.

As shown in FIG. 3, the voicing estimation apparatus 300 of the current embodiment includes a pre-processing unit 301, a Fourier transform unit 302, a smoothing unit 303, a peak detection unit 304, a frequency bound calculation unit 305, a spectral difference calculation unit 306, a local spectral auto-correlation calculation unit 307, and a class determination unit 308.

Figure 4:
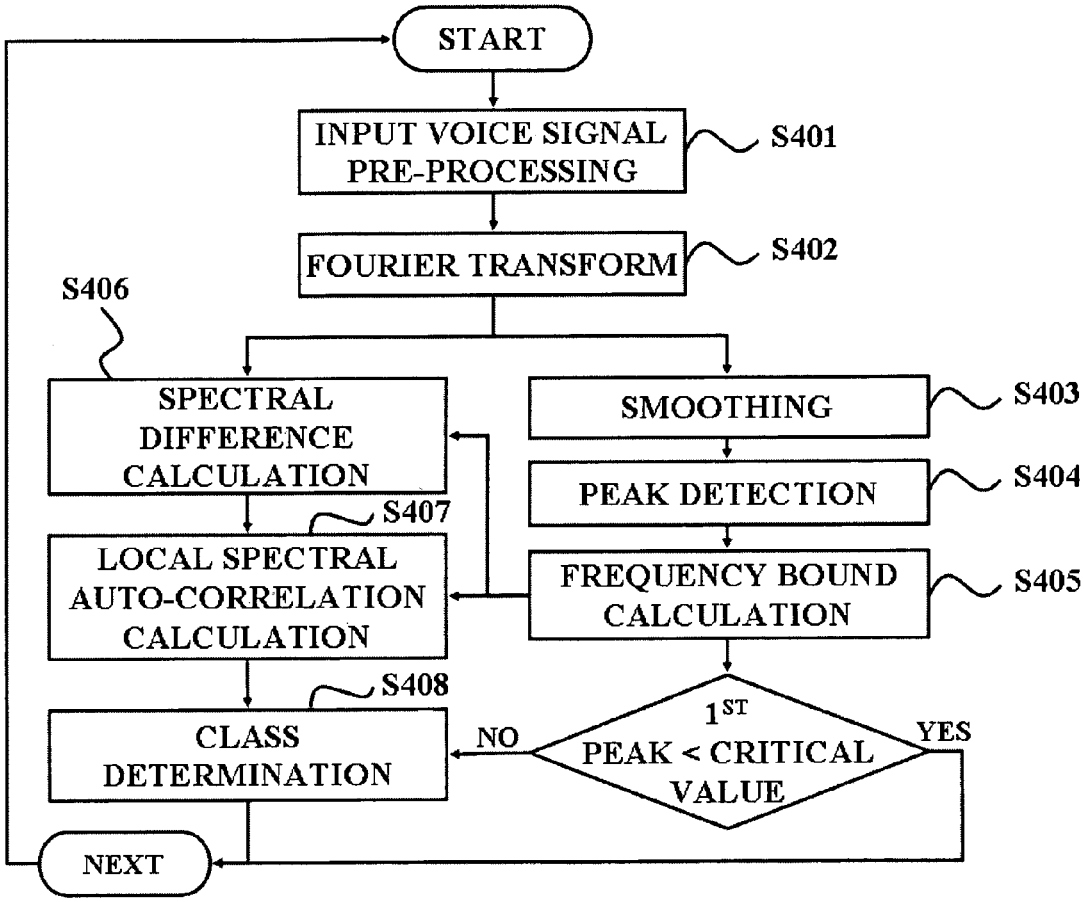
FIG. 4 is a flowchart illustrating a voicing estimation method executed in the apparatus of FIG. 3.

FIG. 4 is a flowchart illustrating a voicing estimation method according to an embodiment of the present invention. For ease of explanation only, this method is described as being executed by the apparatus of FIG. 3.

Referring to FIGS. 3 and 4, in operation S401, the pre-processing unit 301 performs a predetermined pre-processing on input voice signals. In operation S402, the Fourier transform unit 302 converts time domain signals into frequency domain signals by performing a Fourier transform on the pre-processed voice signals as shown in equation 1.

$$A(k) = A(e^{j2\pi kf_s/N}) = \sum_{n=0}^{N-1} s(n)e^{j2\pi knf_s/N} \quad \text{[Equation 1]}$$

In operation S403, the smoothing unit 303 smoothes the transformed voice signals. Then, in operation S404, the peak detection unit 304 detects peaks in the smoothed voice signals.

The smoothing of the transformed voice signals may be based on a moving average of a spectrum and may employ several taps considering the male and female sexes. For example, in view of a pitch cycle, it may be advantageous to use 3~10 taps in the case of a male voice and 7~13 taps in the case of a female voice in 16 kHz sampling. However, since there is no way of anticipating whether a voice will be a male voice or a female voice, approximately fifteen taps may be actually used. This is represented in equation 2.

$$\overline{A}(k) = \sum_{n=0}^{N-1} A(n)h(k-n) \quad \text{[Equation 2]}$$

Figure 5:
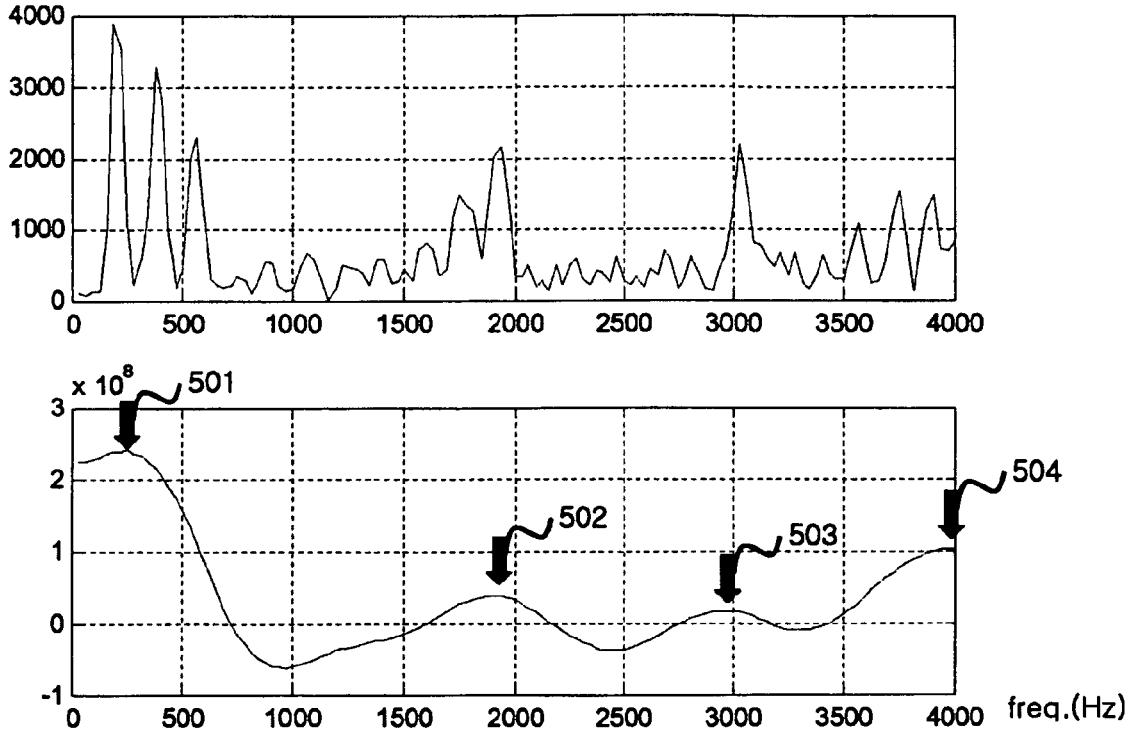
FIG. 5 is an example of graph used for executing operations of smoothing and peak detection.

FIG. 5 is an example of graph used for executing the operations of smoothing and peak detection. FIG. 5 shows that a first peak 501, a second peak 502, a third peak 503 and a fourth peak 504 are detected in the smoothed voice signals.

In operation S405, the frequency bound calculation unit 305 computes every frequency bound associated with the detected peaks. The calculation of the frequency bounds may be executed in order from a low frequency by using a zero-crossing around the detected peaks.

Figure 6:
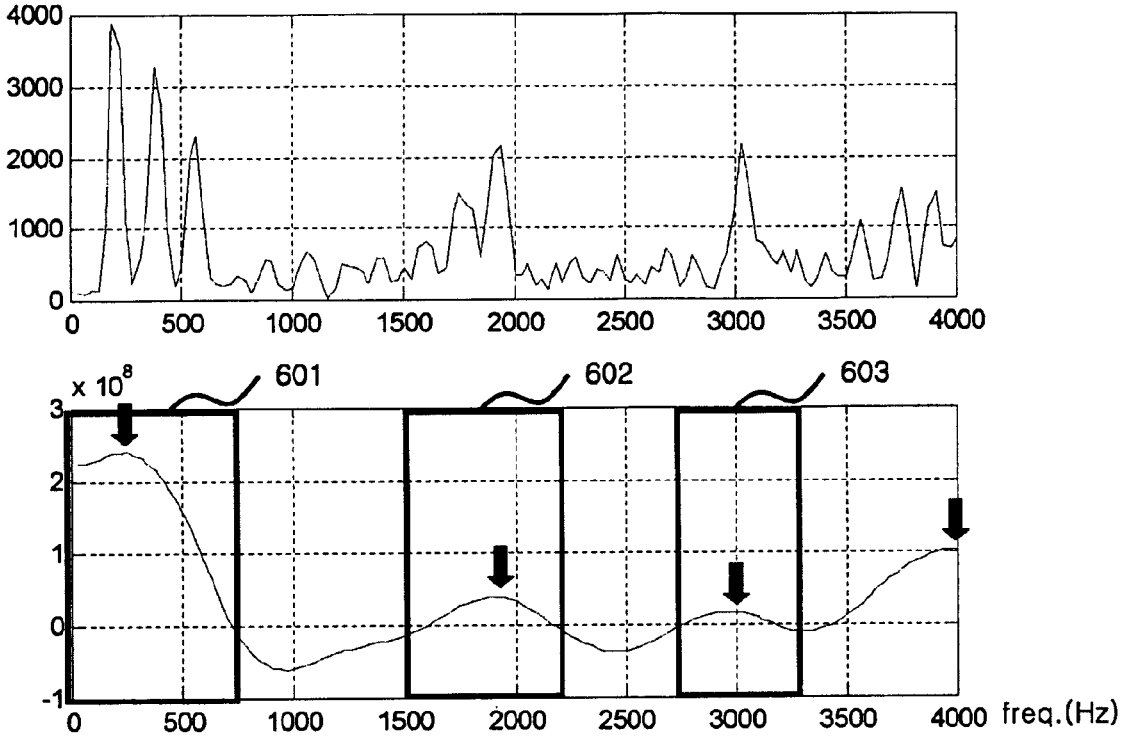
FIG. 6 is an example of graph used for executing an operation of computing every frequency bound.

FIG. 6 is an example of graph used for executing an operation of computing every frequency bound. As shown in FIG. 6, the frequency bound calculation unit 305 can compute three frequency bounds in order from a low frequency, Specifically, a first frequency bound 601 associated with the first peak 501, a second frequency bound 602 associated with the second peak 502, and a third frequency bound 603 associated with the third peak 503. Thus, the frequency bound calculation unit 305 calculates a frequency bound for each detected peak.

In operation S406, the spectral difference calculation unit 306 computes a spectral difference from a difference in a spectrum of the transformed voice signals. This is represented in equation 3.

$$dA(k)=A(k)-A(k-1) \quad \text{[Equation 3]}$$

In operation S407, the local spectral auto-correlation calculation unit 307 computes a local spectral auto-correlation in every frequency bound by using the spectral difference. Here, the local spectral auto-correlation calculation unit 307 may use the calculated spectral difference and then compute the local spectral auto-correlation by performing the normalization. This is represented in equation 4.

$$sa_l(\tau) = \frac{\sum_{i \in P_l} dA(i) \cdot dA(i-\tau)}{\sum_{i \in P_l} dA(i) \cdot dA(i)}, \quad l = 1, 2, 3 \quad \text{[Equation 4]}$$

In the above equation 4, '$P_l$' indicates a section according to a frequency bound, assuming the frequency bound calculation unit 305 computes three frequency bounds in order from a low frequency.

In operation S408, the class determination unit 308 determines a class of a voicing (i.e., a voicing class) according to the calculated frequency bound. Here, based on the local spectral auto-correlation by frequency bound, the class determination unit 308 determines the class of the voicing, as follows.

Initially, when the first local spectral auto-correlation in a lowest frequency bound is greater than a predetermined value, and further, when the second or the third local spectral auto-correlation in the remaining frequency bounds except the lowest frequency bound is greater than the predetermined value, the class determination unit 308 determines the class of the voicing as a vowel. This is represented in equation 5.

Voiced Vowel when $$[sa_1(\tau)>\theta] \text{ and } [\text{exist } l\ sa_l(\tau)>\theta] \quad \text{[Equation 5]}$$

Here, '$\theta$' indicates the predetermined value.

Next, when a first local spectral auto-correlation is greater than the predetermined value, but if both a second and a third local spectral auto-correlations are less than the predetermined value, the class determination unit 308 determines the class of a voicing as a voiced consonant. Assuming the frequency bound calculation unit 305 computes three frequency bounds in order from a low frequency, the above case is represented in equation 6.

Voiced Consonant when $$[sa_1(\tau)>\theta] \text{ and } [\{sa_2(\tau)<\theta\} \text{ and } \{sa_3(\tau)<\theta\}] \quad \text{[Equation 6]}$$

Finally, if the first local spectral auto-correlation is less than the predetermined value, the class determination unit 308 determines the class of a voicing as an unvoiced consonant. This is represented in equation 7.

Unvoiced Consonant when $$sa_1(\tau)<\theta \quad \text{[Equation 7]}$$

Embodiments of the present invention include a program instruction capable of being executed via various computer units and may be recorded in a computer-readable storage medium. The computer-readable medium may include a program instruction, a data file, and a data structure, separately or cooperatively. The program instructions and the media may be those specially designed and constructed for the purposes of the present invention, or they may be of the kind well-known and available to those skilled in the art of computer software. Examples of the computer-readable media include magnetic media (e.g., hard disks, floppy disks, or magnetic tapes), optical media (e.g., CD-ROMs or DVD), magneto-optical media (e.g., optical disks), and hardware devices (e.g., ROMs, RAMs, or flash memories, etc.) that are specially configured to store and perform program instructions. The media may be transmission media such as optical or metallic lines, wave guides, etc. including a carrier wave transmitting signals specifying the program instructions, data structures, etc. examples of the program instructions include both machine code, such as produced by a compiler, and files containing high-level language codes that may be executed by the computer using an interpreter. The hardware elements above may be configured to act as one or more software modules for implementing the operations of this invention.

According to the above-described embodiments of the present invention, provided are a voicing estimation method and apparatus, which can estimate a voicing according to every frequency bound on a spectrum while considering different voicing features between a voiced consonant and a vowel, and which can exactly determine whether a voicing is a voiced consonant or a vowel.

According to the above-described embodiments of the present invention, provided are voicing estimation method and apparatus, which can exactly determine whether a voice signal input is a voicing or not and then determine a class of such a voicing to utilize determination results as factors necessary for a pitch detection or a formant estimation.

According to the above-described embodiments of the present invention, provided are voicing estimation method and apparatus, which can promote an efficiency of speech recognition by exactly differentiating between voiced and unvoiced consonants.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A voicing estimation method for speech recognition implemented by a processor, the method comprising:

performing a Fourier transform on input voice signals after the input voice signals are pre-processed;

smoothing the transformed input voice signals based on a moving average of a spectrum and a predetermined number of taps considering male and females sexes;

detecting peaks in the smoothed input voice signals;

computing frequency bounds respectively associated with each of the detected peaks; and determining a voicing class according to each computed frequency bound.

2. The method of claim 1, wherein the computing of the frequency bound is executed in order from a low frequency by using a zero-crossing around the detected peaks.

3. The method of claim 2, further comprising:

computing a spectral difference from a difference in a spectrum of the transformed input voice signals; and computing a local spectral auto-correlation in every frequency bound using the computed spectral difference.

4. The method of claim 3, wherein the computing a local spectral auto-correlation includes using the computed spectral difference and computing the local spectral auto-correlation by performing a normalization.

5. The method of claim 3, wherein the determining a voicing class is based on the local spectral auto-correlation by frequency bound.

6. The method of claim 5, wherein the determining a voicing class comprises:

determining that the voicing class is a voiced vowel, when a first local spectral auto-correlation in a lowest frequency bound is greater than a predetermined value, and a second or a third local spectral auto-correlation in remaining frequency bounds except the lowest frequency bound is greater than the predetermined value; and determining that the voicing class is a voiced consonant, when the first local spectral auto-correlation is greater than the predetermined value and both the second and the third local spectral auto-correlations are less than the predetermined value.

7. The method of claim 6, wherein the determining a voicing class further comprises determining the class of the voicing as an unvoiced consonant when the first local spectral auto-correlation is less than the predetermined value.

8. A non-transitory computer-readable storage medium storing a program to control at least one processing device to implement the method of claim 1.

9. A voicing estimation apparatus including a processor for speech recognition, the apparatus comprising:

a pre-processing unit pre-processing input voice signals;

a Fourier transform unit Fourier transforming the pre-processed input voice signals;

a smoothing unit smoothing the transformed input voice signals based on a moving average of a spectrum and a predetermined number of taps considering male and female sexes;

a peak detection unit detecting peaks in the smoothed input voice signals;

a frequency bound calculation unit computing frequency bounds respectively associated with the detected peaks; and a class determination unit determining a voicing class according to each computed frequency bound.

10. The apparatus of claim 9, wherein the frequency bound calculation unit computes the frequency bound in an order from a low frequency by using a zero-crossing around the detected peaks.

11. The apparatus of claim 10, further comprising:

a spectral difference calculation unit computing a spectral difference from a difference in a spectrum of the transformed voice signals; and a local spectral auto-correlation calculation unit computing a local spectral auto-correlation in every frequency bound using the computed spectral difference.

12. The apparatus of claim 11, wherein:

the class determination unit determines that the voicing class is a voiced vowel, when a first local spectral auto-correlation in a lowest frequency bound is greater than a predetermined value and a second or a third local spectral auto-correlation in remaining frequency bounds except the lowest frequency bound is greater than the predetermined value; and the class determination unit determines that the voicing class is a voiced consonant, when the first local spectral auto-correlation is greater than the predetermined value, and when both the second and the third local spectral auto-correlations are less than the predetermined value.

13. The apparatus of claim 11, wherein, when the first local spectral auto-correlation is less than the predetermined value, the class determination unit determines that the voicing is an unvoiced consonant.

14. A voicing estimation method for speech recognition implemented by a processor, the method comprising:

Fourier transforming pre-processed input voice signals;

smoothing the transformed input voice signals based on a moving average of a spectrum and a predetermined number of taps considering male and female sexes;

detecting at least one peak in the smoothed input voice signals;

computing a frequency bound for each detected peak, each frequency bound being based on an associated detected peak; and classifying a voicing based on the frequency bounds.

15. A non-transitory computer-readable storage medium storing a program to control at least one processing device to implement the method of claim 14.

* * * * *